US011024127B2

(12) United States Patent
Moskowitz

(10) Patent No.: US 11,024,127 B2
(45) **Date of Patent: *Jun. 1, 2021**

(54) METHODS OF PLAYING WAGERING GAMES WITH THE KENO SYSTEM

(71) Applicant: Ahmnon D. Moskowitz, Silver Spring, MD (US)

(72) Inventor: Ahmnon D. Moskowitz, Silver Spring, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/564,946

(22) Filed: Sep. 9, 2019

(65) Prior Publication Data

US 2019/0392673 A1 Dec. 26, 2019

Related U.S. Application Data

(63) Continuation of application No. 15/707,684, filed on Sep. 18, 2017, now Pat. No. 10,424,166, which is a continuation of application No. 14/668,908, filed on Mar. 25, 2015, now Pat. No. 9,824,544.

(60) Provisional application No. 61/970,249, filed on Mar. 25, 2014.

(51) Int. Cl.
*G07F 17/32* (2006.01)

(52) U.S. Cl.
CPC ..... *G07F 17/329* (2013.01); *G07F 17/3211* (2013.01)

(58) Field of Classification Search
CPC ..... G07F 17/329; G07F 17/3211
See application file for complete search history.

(56) References Cited

U.S. PATENT DOCUMENTS

| | | | |
|---|---|---|---|
| 4,033,588 | A | 7/1977 | Wats |
| 4,277,064 | A | 7/1981 | Newman |
| 4,323,770 | A | 4/1982 | Dieulot et al. |
| 4,494,197 | A | 1/1985 | Troy et al. |
| 4,689,742 | A | 8/1987 | Troy et al. |
| 4,747,600 | A | 5/1988 | Richardson |
| 5,118,110 | A | 6/1992 | Jones |
| 5,380,007 | A | 1/1995 | Travis et al. |
| 5,494,293 | A | 2/1996 | Goldfarb |
| 5,511,784 | A | 4/1996 | Furry et al. |
| 5,772,511 | A | 6/1998 | Smelzer |
| 5,791,991 | A | 8/1998 | Small |
| 5,813,911 | A | 9/1998 | Margolin |
| 5,843,911 | A | 9/1998 | Margolin |
| 5,909,875 | A | 6/1999 | Weingardt |
| 6,168,521 | B1 | 1/2001 | Luciano et al. |

(Continued)

*Primary Examiner* — Kevin Y Kim
(74) *Attorney, Agent, or Firm* — Richard A. Baker, Jr.

(57) ABSTRACT

A method of playing a game that uses the numbers generated by a Keno game is described. The method includes i) receiving a wager from a player, ii) the player selecting to play a matrix-like game displaying through a display medium the player selected variables, with the matrix containing subsets each with a plurality of numbers, the subsets defined by linear contiguous trajectories; vertical, horizontal and diagonal; the subsets including generally equivalent amounts of variables, each subset including a variable that is shared with at least one other subset in the matrix and there are a plurality of subsets that include a variable that are mutually exclusive to another subset within the matrix, and iii) determining the gaming operators variables, displaying the gaming operators variables, determining whether the player wins or loses the game according to predetermined rules.

7 Claims, 6 Drawing Sheets

(56) References Cited

U.S. PATENT DOCUMENTS

| | | | |
|---|---|---|---|
| 6,227,542 | B1 | 5/2001 | Cosmi |
| 6,270,407 | B1 | 8/2001 | Dodge |
| 6,371,482 | B1 | 4/2002 | Hall, Jr. |
| 6,802,506 | B2 | 10/2004 | Spende |
| 7,662,038 | B2 | 2/2010 | Bozeman |
| 9,286,747 | B2 | 3/2016 | Chang |
| 9,561,428 | B2 | 2/2017 | Antonopoulos |
| 9,613,492 | B2 | 4/2017 | Englman |
| 2003/0027621 | A1 | 2/2003 | Libby |
| 2004/0173965 | A1 | 9/2004 | Stanek |
| 2004/0204224 | A1 | 10/2004 | Finnochio |
| 2005/0059465 | A1 | 3/2005 | Bozeman |
| 2005/0064930 | A1 | 3/2005 | Jubinville |
| 2005/0261054 | A1 | 11/2005 | Bress |
| 2013/0116025 | A1 | 5/2013 | Chamberlain |
| 2014/0194177 | A1 | 7/2014 | Moskowitz |
| 2015/0087374 | A1 | 3/2015 | Moskowitz |
| 2015/0339878 | A1 | 11/2015 | Moskowitz |
| 2016/0379443 | A1 | 12/2016 | Abbott |
| 2017/0032622 | A1 | 2/2017 | Moskowitz |

*Keno*

Select game:

Spots 1 2 3 4 5 6 7 9 10 "or More *or Less* ☐ *Cube* ☐ *keno lines* ☐ *keno max* ☐ *carousel* ☐

Select numbers or QP

| | | | | | | | | | |
|---|---|---|---|---|---|---|---|---|---|
| 1 | 2 | 3 | 4 | 5 | 6 | 7 | 8 | 9 | 10 |
| 11 | 12 | 13 | 14 | 15 | 16 | 17 | 18 | 19 | 20 |
| 21 | 22 | 23 | 24 | 25 | 26 | 27 | 28 | 29 | 30 |
| 31 | 32 | 33 | 34 | 35 | 36 | 37 | 38 | 39 | 40 |
| 41 | 42 | 43 | 44 | 45 | 46 | 47 | 48 | 49 | 50 |
| 51 | 52 | 53 | 54 | 55 | 56 | 57 | 58 | 59 | 60 |
| 61 | 62 | 63 | 64 | 65 | 66 | 67 | 68 | 69 | 70 |
| 71 | 72 | 73 | 74 | 75 | 76 | 77 | 78 | 79 | 80 |

Selected to many or too less Quick Fix QF → *Quick Fix*

Amount to wager: 1 2 3 4 5 10 15 20

Number of games: 1 2 3 4 5 10 20

Bonus Multiplier yes no

FIG. 1

*More or less* *1.00*

| | | | | | | | | | |
|---|---|---|---|---|---|---|---|---|---|
| 3 | 4 | 8 | 9 | 10 | 11 | 12 | 14 | 15 | 19 |
| 20 | 25 | 27 | 28 | 29 | 30 | 31 | 33 | 35 | 37 |
| 41 | 47 | 53 | 54 | 55 | 56 | 57 | 58 | 58 | 64 |
| 65 | 66 | 67 | 71 | 74 | 75 | 76 | 77 | 78 | 79 |

Bar code game 201

FIG. 3a

*More or less pay table*

| | | | |
|---|---|---|---|
| 20 | 125,000 | 0 | 125,000 |
| 19 | 6000 | 1 | 6000 |
| 18 | 1000 | 2 | 1000 |
| 17 | 100 | 3 | 100 |
| 16 | 15 | 4 | 15 |
| 15 | 5 | 5 | 5 |
| 14 | 3 | 6 | 3 |
| 13 | 1 | 7 | 1 |

FIG. 3b

*Cubed*

| | | |
|---|---|---|
| V1 | V2 | V3 |
| V4 | free | V6 |
| V7 | V8 | V9 |

FIG. 4a

| | | |
|---|---|---|
| V1 | V2 | V3 |
| V4 | V5 | V6 |
| V7 | V8 | V9 |

FIG. 4b

Line subset 1 (Horizontal): {V1, V2, V3}
Line subset 2 Horizontal) : {V4, V5 V6}
Line subset 3 (Horizontal) :{ V7, V8, V9}
Line subset 4 (Vertical) :{ V1, V 4, V 7}
Line subset 5 (Vertical) : {V2 V5 V8}
Line subset 6 (Vertical) :{ V3, V6, V9}
Line subset 7: (diagonal) : {V1, V5. V9}
Line subset 8: (diagonal) : {V7, V7. V3}
Corner subset :{ V1, V3 V7, V9}
Total set : {V1, V2, V3, and V4 V5 V6 V7 V8}

FIG. 4c

| | |
|---|---|
| 1 line | 1 |
| 2 lines | 3 |
| 3 lines | 15 |
| 4 lines | 50 |
| 5 lines | 150 |
| 6 lines | 600 |
| 7 or 8 lines | 10,000 |

FIG. 4d

*KENO LINES*

| | | | |
|---|---|---|---|
| V1 | V2 | V3 | V4 |
| V5 | V6 | V7 | V8 |
| V9 | V10 | V11 | V12 |
| V13 | V14 | V15 | V16 |

FIG. 5a

| | | | |
|---|---|---|---|
| V1 | V2 | V3 | V4 |
| V2 | V4 | V1 | V3 |
| V5 | V6 | V7 | V8 |
| V7 | V5 | V8 | V6 |

FIG. 5b

*Keno MAX*

| | | | | |
|---|---|---|---|---|
| V1 | V2 | V3 | V4 | V5 |
| V6 | V7 | V8 | V9 | V10 |
| V11 | V12 | Vfree | V14 | V15 |
| V16 | V17 | V18 | V19 | V20 |
| V21 | V22 | V23 | V24 | V25 |

FIG. 5c

| | | | | |
|---|---|---|---|---|
| V1 | free | V2 | free | V3 |
| free | v4 | v5 | V1 | free |
| v6 | v7 | free | V8 | V2 |
| free | V9 | v10 | V3 | free |
| V4 | free | V6 | free | V9 |

FIG. 5d

METHODS OF PLAYING WAGERING GAMES WITH THE KENO SYSTEM

CROSS-REFERENCE TO RELATED APPLICATIONS

This application is a Continuation of U.S. patent application Ser. No. 15/707,684, filed on Sep. 18, 2017, entitled "METHODS OF PLAYING WAGERING GAMES WITH THE KENO SYSTEM". U.S. patent application Ser. No. 15/707,684 is a Continuation of U.S. patent application Ser. No. 14/668,908, which is a non-provisional application, for which priority is claimed under 35 U.S.C. § 119, of U.S. Provisional Patent Application No. 61/970,249, filed Mar. 25, 2014, and entitled "METHODS OF PLAYING WAGERING GAMES WITH THE KENO SYSTEM FIELD OF THE INVENTION," the entire content of the above three identified patent applications are is incorporated herein by reference in its entirety.

COPYRIGHT NOTICE

A portion of the disclosure of this patent document contains material to which a claim for copyright is made. The copyright owner has no objection to the facsimile reproduction by anyone of the patent document or the patent disclosure, as it appears in the Patent and Trademark Office patent file or records, but reserves all other copyright rights whatsoever.

FIELD OF THE INVENTION

The present invention involves games to be played in conjunction with a Keno system.

BACKGROUND OF THE INVENTION

Keno is a game in which a player selects numbers from a grid of eighty squares, with each square numbered from one to eighty in sequence. The player first determines how many numbers (or "spots") to select. A player picks generally 1-10 numbers (or "spots"), the number of spots selected determines the payout odds. There are variations of Keno i.e. "Tatts keno" plays with a grid of 70 variables, and some casinos allow a player to pick up to 20 spots.

The conventional art in Keno has different ways of selecting the spots. In a "way bet" a player picks a combination of spots. Many times in way-keno, groups of numbers are separated by lines or circles. The groups are then combined together to make individual tickets for all the ways that a player wishes to play. Another method of selecting numbers is "Pattern Keno" U.S. Pat. No. 5,813,911, 1998, Margolin teaches a method of selecting numbers by selecting shapes; there are no rules within that are unique to Keno.

The exemplary embodiments of the invention provide alternative ways to play_traditional Keno that are simple for a player to understand and can be played in conjunction with the Keno system in order to keep players excited within game play.

A player gets upset when they are watching Keno and are not matching many variables. An exemplary embodiment of the invention gives a player a means to win if only a minority of the players' variables match the gaming operator's variables.

Launching new games call for costly investments by the gaming operator and if it fails much is lost. An exemplary embodiment of the invention saves the gaming operator money in start-up and marketing costs by creating games to be played within the Keno System to reduce the costs of launching and operating a separate game.

SUMMARY OF THE INVENTION

The present invention relates to exemplary methods of playing games in conjunction with a Keno system.

An exemplary method of playing a game disclosed herein is "More or Less" to be played in conjunction with a KENO system. In this example embodiment, a player selects 40 variables from a grid of 80, the gaming operator selects 20 variables. The payouts for a player matching 0, 1, 2, 3, 4, 5, 6, 7 variables of the said 40 have a substantially equivalent pay table to a player matching 20, 19, 18, 17, 16, 15, 14, 13 of the said 40 with no payouts for a player matching 8, 9, 10, 11, 12.

The exemplary game "More or Less" does not necessarily need to have near symmetrical payouts or be played with 40 variables. It can be played with any amount of selected variable over 15; 15-20, 21-25, 26-30, 31-35, 36-40, 41-45, and 46-50, 51-55, 56-60. The game does need to pay a prize for matching all the selected variables, exactly all the selected variables less one, exactly all less two and exactly all less three, and for a payout for matching zero variables, exactly one variable, exactly two variables, and exactly three variables.

Another exemplary embodiment of a game is disclosed wherein a players' selected variables are to be displayed upon a matrix on uniquely identifiable positions.

The matrix (see FIGS. 4*a*, 4*b*, 5*a*, 5*b*, 5*c*, 5*d*) contains subsets (Line subset 1-8, corner subset) each with a plurality of numbers (V1-V25), the subsets defined by linear contiguous trajectories (Line subset 1-8); vertical (Line subset 4-6), horizontal (Line subset 1-3) and diagonal (Line subset 7-8); the subsets contain generally equivalent amounts of variables, each subset contains a variable (V1-V25) that is shared with at least one other subset in the matrix and there are a plurality of subsets that contains a variable that are mutually exclusive to another subset within the matrix.

If a player matches all the variables (V1-V25) within a subset (Line subset 1-8, corner subset) a player is entitled to a value prize. If a player matches all of the numbers (V1-V25) in a plurality of subsets a player is entitled to a value payout that is generally higher than the combination of payouts the player would have received as if the subsets were won in separate games. The subsets that can be required for a player to match in order to win need not be limited to linear contiguous trajectories (Line subset 1-8), other subsets can be the following; the corners of the grid (corner subset), a letter shape, a number shape, heart shape, diamond shape or any other symbol or pattern shape.

The aforementioned exemplary embodiments of games can be played in conjunction with any KENO venue, such as an online lottery, gaming hall, instant game, or an electronic gaming device.

Other features and advantages of the present invention will become apparent to those skilled in the art upon review of the following detailed description and drawings.

BRIEF DESCRIPTION OF THE DRAWINGS

These and other aspects and features of embodiments of the present invention will be better understood after a reading of the following detailed description, together with the attached drawings, wherein:

FIG. 1 is an illustration of a play slip for exemplary embodiments of games described herein;

FIG. 3*a* is an illustration of a wage slip for the game "More or Less";

FIG. 3*b* is an illustration of a possible pay table for "More or Less";

FIG. 4*a* is an illustration of a game to be played in conjunction with the Keno grid with three rows and three columns;

FIG. 4*b* is an illustration of an alternative variation to 4A with no free variable;

FIG. 4*c* is a mathematical breakdown of possible subsets contained in 4A and 4B;

FIG. 4*d* is a possible pay table for the game illustrated in 4*a;*

FIG. 5*a* is an illustration of an exemplary embodiment of a game to be played in conjunction with the Keno grid with four rows and four columns;

FIG. 5*b* is an illustration of an alternative variation of the game in 5A with repeating numbers;

FIG. 5*c* is an illustration of an exemplary embodiment of a game to be played in conjunction with the Keno grid with five rows and five columns;

FIG. 5*d* is an illustration alternative game to 5*c* to be played with free variables and repeating numbers.

DETAILED DESCRIPTION OF THE EXEMPLARY EMBODIMENTS OF THE INVENTION

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

FIG. 1 illustrates an exemplary embodiment of a standard play slip for KENO where a player marks the spots, spot selection, and amount of games. This play slip has two differences with other play slips: 1) it contains options to play games mentioned within this disclosure and 2) it contains a "Quick Fix" option. If a player selected too many or too few variables, either the player or the teller with the players permission would mark the indicia near "Quick fix" and the gaming operator's processor would randomly add or subtract (a) variable(s) from the player's selection as to conform to the spot selection.

Figure 2:
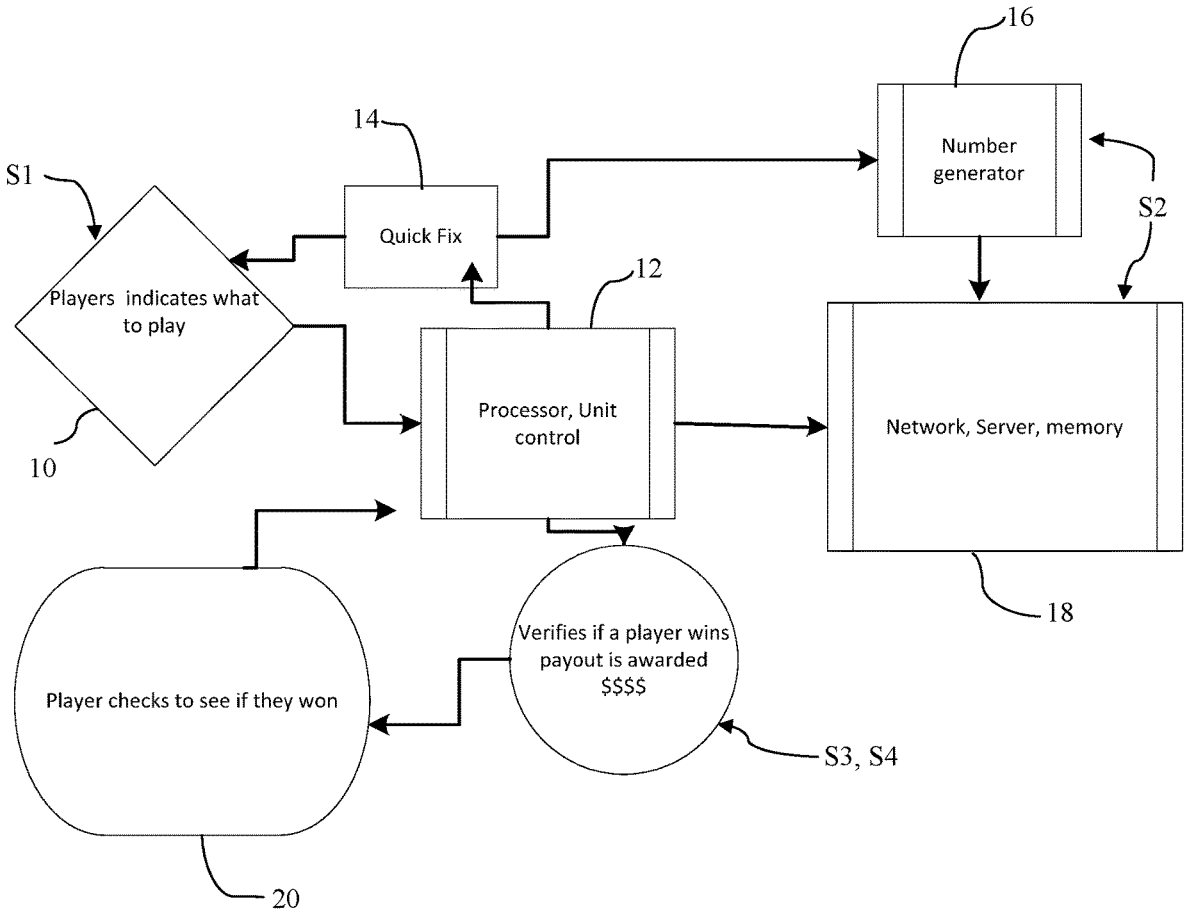
FIG. 2 is a flow chart schematically illustrating the interactions of a player and a gaming operator.

FIG. 2 is a flow chart of an exemplary game process in which a player selects a game. This can be done through a lottery network system, casino system, electronic gaming device system, or internet system, etc. A player can use a play slip, verbally indicate the selection for the teller to input, or select the options from a display screen.

Many gaming operators have a plurality of terminals that send and receive data via a centralized processing unit. The central processor is connected to a multitude of remote terminals with each terminal having the ability of sending and receiving data inputs to the central processing unit, with such data inputs including the identification of the playing console, the amount played, and the game selection which could be instant game or a delayed game. The terminal will either accept or reject the bet determining if it is valid or not. In a land based system a ticket identifying the characteristics of the bet would be printed. A means of verifying the validity of the ticket would also be printed on the ticket.

With reference to FIG. 2, generally, the steps include, but are not limited to the following. In step (S1), a player selects a game and wages money (e.g., using an input device or unit 10 or the like; or an operator inputs the selection on behalf of the player). If a selection is determined to be incorrect by a controller 12 (e.g., processor, control unit, etc.), the controller 12 can send the selection back to the player to manually correct the selection, or give the player the option to use a "Quick Fix" option 14, which can add or subtract variables to conform to the player's game selection. When the wager is determined to be consistent with game rules (e.g., predetermined rules, for example, stored in a memory 18), the controller 12 can accept the wager. In step (S2), a gaming operator can generate random numbers using, for example, an electronic random number generator 16 or the like, such as a mechanical blower, and in other situations the numbers can pre-determined (e.g., stored in memory 18, etc., which may be local or accessible over a network, etc.). In step (S3), the controller 12 (e.g., the gaming operators' computer central processing unit) can determine if a player won. In step (S4), the controller can be programmed to pay, authorize the payment of, or indicate (e.g., via a display 20 or printed medium) an award that corresponds to the players selection once verified.

FIG. 3*a* is an example of a "More or less" lottery ticket given to a player when a wager is made. There is a barcode at the bottom used to verify if the ticket is a winner. If this game is played on an electronic gaming device system or through the internet there could be a virtual ticket that may be associated with a record file entry in a database and the selected variables are displayed on a monitor.

FIG. 3*b* is an example of the pay table for the game "More or Less". In this example, the lottery operator has a more than 40% edge over the player consistent with state lottery games. Casinos or other gaming systems would likely want to increase the payouts so as to make the payouts more attractive to players. It can be appreciated the complete symmetry in payouts and there is a payout for all player sceneries with the exception of matching 8, 9, 10, 11, or 12, variables. Here there is a single top payout of $125,000 for matching all or none of the selected variables; however some lottery operators may want to have a progressive jackpot whereby the top prize increases every game that a player does not win.

An exemplary embodiment may have a generally symmetric payout since it will look alluring in marketing campaigns, however in accordance with this invention the amount variables and pay scales can vary as long as the players selected variables are at least 15 and there is a payout for matching; all, all less one, all less two, zero, exactly one and exactly two.

Illustrated in FIGS. 4*a*, 4*b*, 5*a*, 5*b*, 5*c*, 5*d*, and 5*e* are exemplary embodiments of games that are to be played alongside a Keno system, where the gaming operator selects 20 variables out of a grid of 80. Player's variables are displayed in a uniquely identifiable area in a display area separate from the Keno grid; the variables are indicated by numbers seceding V, the variables are contained in a grid within rows and columns. The player variables in the cell may be selected by a player, or generated by a random number selector, the numbers can be arranged sequentially, or non-sequentially. The variables within the cells are numbers to be matched with the gaming operator's selection, however bonuses or other symbols can be contained within, for example FIGS. 4*a*, 5*a*, and 5*b* contain a free variable in the center of the grid. The payout for matching a subset with two variables and a free variable is the same as matching three variables without the free variable.

In FIGS. 4*a* and 4*b*, the numbers are arranged in grid of 3 rows and 3 columns each of the variables (V1-V9) contained in a uniquely identifiable position within a cell. In FIG. 4*a*, there are 8 unique variables (V1-V4, V6-V9) with a free space in 4 *b* there are 9 unique variables. FIG. 4*c* is a mathematical breakdown of the subsets (Line subset 1-8, corner subset) of FIGS. 4*a* and 4*b*; vertical (Line subset 4-6), horizontal (Line subset 1-3) diagonal (Line subset 7-8). The subsets are the representation of variables adjoined within the horizontal (Line subset 1-3), diagonal (Line subset 7-8), vertical (Line subset 4-6) lines and the four corners (corner subset). A player wins a prize by matching all the variables in a subset; if a player matches a plurality of subsets they are entitled to a prize that is generally higher than the combination of payouts as if they would have matched the subsets in two separate games. A player wins the top prize by matching all the variables in all the subsets. FIG. 4*d* is a pay table for the game in FIG. 4*a*; if a player matches a line in the vertical (Line subset 4-6), horizontal (Line subset 1-3) or diagonal (Line subset 7-8) they are entitled to a value payout. If a player matches one line they are entitled to a dollar if a player matches a second they are entitled to $3, three lines $15, four lines $50, five lines $150, six lines $600 and seven or eight lines $10,000. The top payout could be progressive, the payouts contained herein represent an edge consistent with government managed lotteries, non-government run gaming operators will likely want to increase the payouts mentioned herein.

In FIGS. 5*a* and 5*b*, there are 4 rows and 4 columns with 16 cells; FIG. 5*a* containing 16 unique variables and FIG. 5*b* containing 8 unique variables; a player receives a prize by matching a vertical, horizontal, or diagonal line and a more substantial prize for matching a plurality of lines. It is possible to have 16 individual unique variables and a top prize for matching not all but a majority of lines or variables. It can be appreciated that within the cube of FIG. 5*b* are only 8 unique player variables and no two identical variables are contained within a single subset.

In FIGS. 5*c* and 5*d*, there are 5 rows and 5 columns each containing a free space in the center; FIG. 5*c* contains 24 unique variables, FIG. 5*d* contains 10 unique variables and 9 free spaces, it can be appreciated that no two identical variables are contained in a single subset; a player receives a prize by matching a vertical horizontal or diagonal line and a more substantial prize for matching a plurality of lines. A gaming operator can decide to award prizes for matching a unique pattern within the grid. The pattern could be a diamond, heart shape, number shape, letter shape or some other symbol or pattern. A gaming operator can also offer a payout for matching both diagonals that would be generally higher than a payout for matching two other linear subsets. These games can be played in conjunction with bonuses or in conjunction with other features that are known in the art of Keno and Bingo.

Figure 5E:
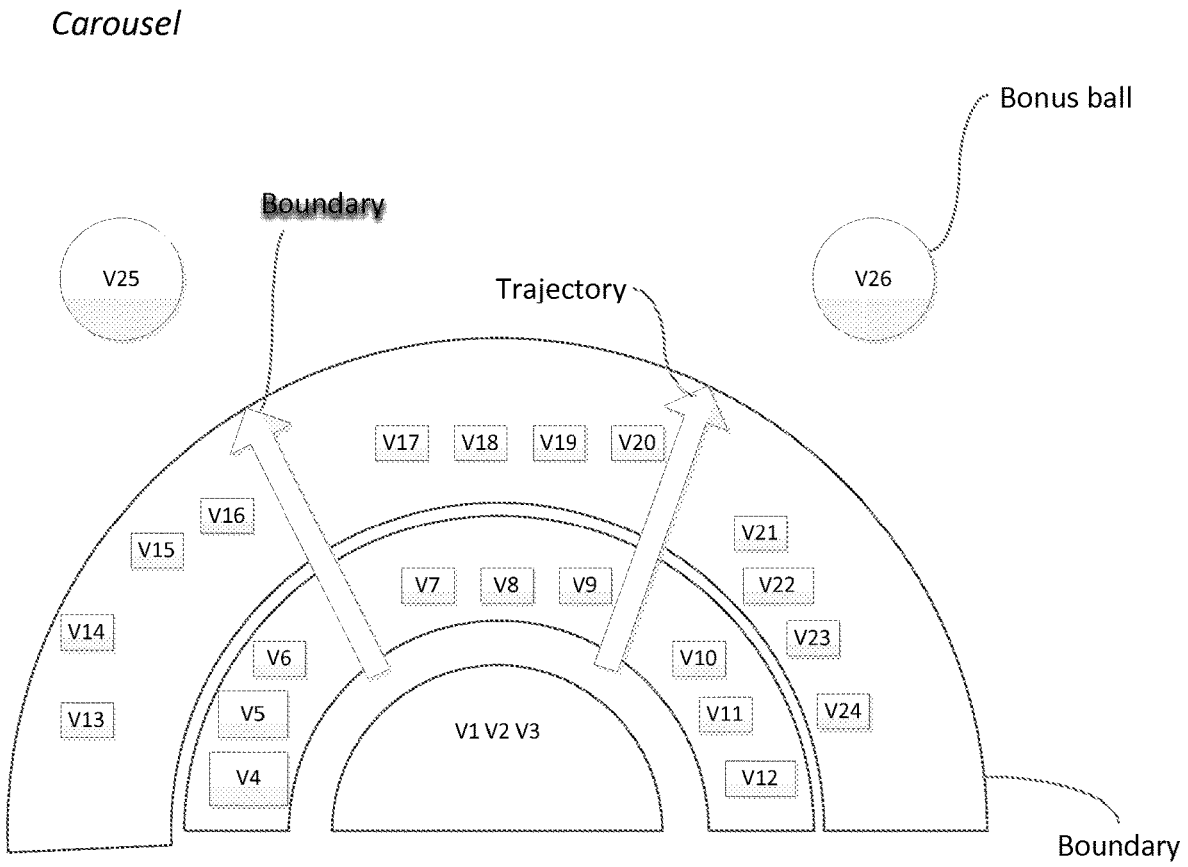
FIG. 5*e* is an illustration of an exemplary embodiment of a game played on a grid that is curvilinear.

The exemplary embodiment of this game does not need to be played as a cubed grid. In other examples, the game can be played on a grid that is generally rectangular, or it can be played on a grid that is letter-, number-, or symbol-shaped like a star or pyramid, etc. FIG. 5*e* is a game with numbers displayed upon on a grid that is curvilinear; a player has several ways to win; they receive a prize by matching variables within the boundaries and a prize for matching variables along the trajectory, and there are bonus balls.

To summarize, exemplary methods of playing games in conjunction with a Keno system are described above. In an example game, 40 variables are selected; the payouts to a player matching 0, 1, 2, 3, 4, 5, 6, and 7 variables of the 40 have substantially equivalent payouts to a player matching 20, 19, 18, 17, 16, 15, 14, and 13 of the 40. In another example game, a player's variables (V1-V25) are displayed on a matrix separate from the Keno grid. The Matrix contains a plurality of subsets defined by variables (V1-V25) in uniquely identifiable positions adjoined along linear contiguous trajectories. For each subset, a player matches with the gaming operators variables there is a prize. The subsets contain variables (V1-V25) that overlap each other; with the said overlapping variables each in a singularly uniquely identifiable area within the grid. If a player matches a plurality of subsets, the player is entitled to a prize that is generally higher than the combination of payouts as if they would have matched the subsets as separate games.

An exemplary embodiment is directed to a method of playing a game that uses the numbers generated by a Keno game in which the method comprises executing instructions on a processor in a computer to implement the following operations: receiving a wager from a player (e.g., input by a player), the player selection being, for example, at least 21 variables; displaying on a display medium (e.g., display, display device, etc.) the player's selected variables; determining the gaming operators variables (e.g., by a controller programmed to control the game); displaying the gaming operators variables (e.g., on a display); determining (e.g., by a controller programmed to control the game) whether the player wins or loses the game according to electronically stored predetermined rules, for example which are implemented by the processor on the computer, wherein the predetermined rules include a value payout for: i) matching all variables, exactly all variables less than one, and exactly all variables less than two; ii) matching zero variables, for matching exactly one variable, and exactly two variables; and resolving the wager according to an electronically stored pay table.

In an example, the payout for matching all variables and zero variables are generally equivalent (e.g., substantially equivalent), the payout for matching all variables less than one and exactly one are generally equivalent, the payout for matching all variables less than two and exactly two are generally equivalent (e.g., substantially equivalent). In another example, there is a payout for matching all variables less than three and exactly three, a payout for matching all variables less than four variables and exactly four variables.

Another exemplary embodiment is directed to a method of method of playing a game that uses the numbers generated by a Keno game, the method comprising executing instructions on a processor in a computer (e.g., by a controller programmed to control the game) to implement the following operations: a player selecting variables (V1-V25) for the game (e.g., a player inputting variables (V1-V25) into an input unit); displaying on a display medium (e.g., display, display device, etc.) the player's selected variables (V1-V25); displaying (e.g., on the display) the gaming operator's variables, for example, in the following arrangement; i) a player's selected variables (V1-V25) are displayed within a matrix (see FIGS. 4*a*, 4*b*, 5*a*, 5*b*, 5*c*, 5*d*) separate from the keno grid and each variable (V1-V25) is within a uniquely identifiable area, wherein the matrix has subsets (Line subset 1-8, corner subset), and a subset (Line subset 1-8, corner subset) is defined as a combination of variables (V1-V25) that if matched to the gaming operator's variables entitles a player to a value payout; ii) there are pluralities of subsets (Line subset 1-8, corner subset) that share a mutual variable; the said variable (V1-V25) is located in a uniquely identifiable area; iii) the said subsets (Line subset 1-8, corner subset) adjoin the uniquely identifiable area of the said variable (V1-V25) within the display area; the method further including determining whether the player wins or loses the game according to electronically stored predetermined rules which are implemented by the processor on the computer (e.g., by a controller programmed to control the game), the predetermined rules including: i) if a player matches all variables (V1-V25) in a subset (Line subset 1-8, corner subset) to a gaming operators draw a prize is awarded; ii) if at least one subset (Line subset 1-8, corner subset) within the matrix contains a variable (V1-V25) that is mutually exclusive to another subset within the matrix; and iii) if a player matches a plurality of subsets (Line subset 1-8, corner subset) they are entitled to a prize that is generally higher than the combination of payouts as if they would have matched the subsets (Line subset 1-8, corner subset) as two separate games; the method further including resolving the wager according to said electronically stored pay table.

In an example, a variable (V1-V25) in a subset (Line subset 1-8, corner subset) is an automatic free variable within the game. In another example, the characters are displayed on horizontal (Line subset 1-3) and perpendicular lines (Line subset 4-6). In another example, the players selected numbers (V1-V9) are displayed on a grid comprising nine variables (V1-V9), three variables adjoined contiguously on the vertical trajectory (Line subset 4-6), and three variables adjoined contiguously on the horizontal (Line subset 1-3); the said horizontal and vertical trajectories transverse each other. In another example, the player's selected numbers (V1-V25) are displayed in a triangular formation. In another example, the numbers are displayed in a generally curvilinear formation. In another example, a variable selected by the player can be displayed within a plurality of uniquely identifiable positions; the said variable (V1-V25) belonging to separate subsets (Line subset 1-8, corner subset) within the game.

Another exemplary embodiment is directed to an apparatus or system for playing a game that uses numbers generated by a Keno game, the apparatus or system comprising a display; an input device; and a controller programmed to control the game based on an input from the input device and display indicia with respect to the game. The controller can be programmed to: receive a wager input by a player from the input device, with the player selection being at least 21 variables; display on the display the player's selected variables; determine the gaming operators variables; display the gaming operators variables; determine whether the player wins or loses the game according to electronically stored predetermined rules which are implemented by the processor on the computer, wherein the predetermined rules include: i) there is a value payout for matching all variables, exactly all variables less than one, and exactly all variables less than two; ii) there is a value payout for matching zero variables, for matching exactly one variable, and exactly two variables; resolving the wager according to an electronically stored pay table.

The present invention has been described herein in terms of several preferred embodiments. However, modifications and additions to these embodiments will become apparent to those of ordinary skill in the art upon a reading of the foregoing description. It is intended that all such modifications and additions comprise a part of the present invention to the extent that they fall within the scope of the several claims appended hereto.

Like numbers refer to like elements throughout. In the figures, the thickness of certain lines, layers, components, elements or features may be exaggerated for clarity.

The terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

The various illustrative logical blocks, modules, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The methods, sequences and/or algorithms described in connection with the embodiments disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor. The processor and the storage medium may reside in an ASIC. The ASIC may reside in a terminal. In the alternative, the processor and the storage medium may reside as discrete components in a terminal.

In one or more exemplary embodiments, the functions described may be implemented in hardware, software, firmware, or any combination thereof. If implemented in software, the functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and blu-ray disc where disks usually reproduce data magnetically, while discs reproduce data optically with lasers. Combinations of the above should also be included within the scope of computer-readable media.

While the foregoing disclosure shows illustrative embodiments of the invention, it should be noted that various changes and modifications could be made herein without departing from the scope of the invention as defined by the appended claims. The functions, steps and/or actions of the method claims in accordance with the embodiments of the invention described herein need not be performed in any particular order. Furthermore, although elements of the invention may be described or claimed in the singular, the plural is contemplated unless limitation to the singular is explicitly stated.

I claim:

1. A printed ticket for a lottery game using player and gaming operator Keno variables, the printed ticket comprising:

numeric variables displayed within a matrix separate from a Keno grid, with each of the numeric variables printed within the matrix in a display area, wherein the matrix has a plurality of subsets including a combination of the numeric variables, where the plurality of subsets share a mutual variable, wherein the mutual variable is located in a uniquely identifiable area;

the plurality of subsets adjoining the uniquely identifiable area of the mutual variable within the display area;

the matrix arranged with a plurality of variables, and a plurality of free spaces;

identifying characteristics printed on the ticket stored on a memory of a lottery gaming server, where said ticket is a winner if the ticket matches all of the numeric variables in the subset to a gaming operator's variables, the characteristics are identified using a lottery gaming terminal with ticket information retrieved from a central processing unit of the lottery gaming server, where the ticket information includes a ticket identity, information on a value and validity information.

2. The printed ticket of claim 1 wherein the matrix is a three by three matrix.

3. The printed ticket of claim 1 wherein the matrix is a five by five matrix.

4. A method of conducting a lottery game on a computer system with a printed ticket generated by a gaming terminal, where the gaming terminal comprises of at least one processor that is coupled to at least one memory device wherein the at least one processor is responsive to a player's input instructions, the method comprising:

selecting, by the player, to play the lottery game with a predetermined quantity of numeric variables to be played in the lottery game and the player selecting numerical variables wherein if the player selected an incorrect quantity of the numeric variables other than the predetermined numeric quantity on a play slip, providing the player with an option to select a feature wherein the feature, when activated by the player, adjusts the quantity of the numeric variables to the predetermined quantity selection, selecting new numeric variables through use of a random number generator via the at least one processor;

receiving the numeric variables as at least in-part marked on the play slip as provided by the player on an input device for reading the play slip on the gaming terminal, for the game;

transmitting the numeric variables to the computer system for storage;

receiving identifying characteristics from the computer system;

printing on the printed ticket the selected numeric variables and the identifying characteristics;

reading the selected numeric variables and the identifying characteristics from the printed ticket using the gaming terminal;

receiving the identifying characteristics as stored from the computer system;

comparing a gaming operator's variables to the printed selected numeric variables on the printed ticket;

validating the printed ticket using the printed identifying characteristics and the stored identifying characteristics; and determining whether the player wins or loses the game according to electronically stored predetermined rules.

5. The method according to claim 4 wherein additional numeric variables are added to the numeric variables via the at least one processor if the numeric variables quantity is less than the predetermined quantity of the numeric variables.

6. The method according to claim 4 wherein numeric variables are subtracted from the numeric variables via the at least one processor if the numeric variables quantity is greater than the predetermined quantity of the numeric variables.

7. A printed ticket generated for a lottery game using Keno variables, the printed ticket comprising:

forty player selected numeric variables and identifying characteristics printed on the ticket;

the identifying characteristics stored in a memory of a lottery network;

receiving identifying characteristics from the lottery network;

wherein the player is a winner if:

zero, one, twenty, nineteen or eighteen numeric variables match a gaming operator's variables;

reading the selected numeric variables from the printed ticket and the identifying characteristics from the printed ticket using a gaming terminal;

receiving the stored identifying characteristics from the lottery network;

comparing the gaming operator's variables to the printed selected numeric variables on the printed ticket;

validating the printed ticket using the printed identifying characteristics and the stored identifying characteristics; and determining whether the player wins or loses the game according to electronically stored predetermined rules.

* * * * *